US010428406B2

(12) United States Patent
Yao et al.

(10) Patent No.: US 10,428,406 B2
(45) Date of Patent: Oct. 1, 2019

(54) WEAR RESISTANT AND CORROSION RESISTANT COBALT-BASED ALLOY POWDERS AND APPLICATIONS THEREOF

(71) Applicant: Kennametal Inc., Latrobe, PA (US)

(72) Inventors: Matthew Yao, Belleville (CA); Abdelhakim Belhadjhamida, Kingston (CA); David A. Lee, Ligonier, IN (US); Qingjun Zheng, Export, PA (US)

(73) Assignee: KENNAMETAL INC., Latrobe, PA (US)

( * ) Notice: Subject to any disclaimer, the term of this patent is extended or adjusted under 35 U.S.C. 154(b) by 0 days.

(21) Appl. No.: 15/425,781

(22) Filed: Feb. 6, 2017

(65) Prior Publication Data

US 2017/0233852 A1 Aug. 17, 2017

Related U.S. Application Data

(60) Provisional application No. 62/294,785, filed on Feb. 12, 2016.

(51) Int. Cl.

| | |
|---|---|
| ***C22C 19/07*** | (2006.01) |
| ***C23C 4/129*** | (2016.01) |
| ***B22F 1/00*** | (2006.01) |
| ***C23C 4/06*** | (2016.01) |

(52) U.S. Cl.

CPC ..... *C22C 19/07* (2013.01); *B22F 1/0003* (2013.01); *C23C 4/06* (2013.01); *C23C 4/129* (2016.01); *B22F 2301/15* (2013.01); *Y10T 428/12063* (2015.01)

(58) Field of Classification Search

None

See application file for complete search history.

(56) References Cited

U.S. PATENT DOCUMENTS

| | | | | |
|---|---|---|---|---|
| 3,313,633 | A * | 4/1967 | Longo | C22C 32/0073 106/1.05 |
| 2014/0271318 | A1* | 9/2014 | Zheng | B22F 7/008 419/7 |
| 2014/0271319 | A1* | 9/2014 | Zheng | B22F 7/04 419/9 |

FOREIGN PATENT DOCUMENTS

| | | | |
|---|---|---|---|
| CN | 107083502 | A | 8/2017 |
| DE | 102017101919 | A1 | 8/2017 |
| GB | 933406 | | 8/1963 |
| GN | 778359 | * | 7/1957 |
| JP | S59211546 | A | 11/1984 |

OTHER PUBLICATIONS

Wikipedia, Thermal Spraying, Jan. 22, 2016.
Feb. 5, 2019 Foreign OA.

* cited by examiner

*Primary Examiner* — Daniel J. Schleis
(74) *Attorney, Agent, or Firm* — Larry R. Meenan

(57) ABSTRACT

Cobalt-based alloy compositions are described herein having properties compatible with thermal spray and sintering techniques. Such alloy compositions can provide claddings to a variety of metallic substrates having complex geometries, wherein the claddings exhibit desirable density, hardness, wear resistance and corrosion resistance. Briefly, an alloy composition described herein comprises 15-25 wt. % chromium, 15-20 wt. % molybdenum, 0-15 wt. % tungsten, 10-20 wt. % nickel, 2.5-3.5 wt. % boron, 2.5-4.5 wt. % silicon, 1-2 wt. % carbon and the balance cobalt, wherein a ratio of boron to silicon (B/Si) in the alloy composition ranges from 0.5 to 1.0.

22 Claims, 3 Drawing Sheets

WEAR RESISTANT AND CORROSION RESISTANT COBALT-BASED ALLOY POWDERS AND APPLICATIONS THEREOF

RELATED APPLICATION DATA

The present application claims priority pursuant to 35 U.S.C. § 119(e) to U.S. Provisional Patent Application Ser. No. 62/294,785 filed Feb. 12, 2016 which is hereby incorporated by reference in its entirety.

FIELD

The present invention relates to alloy compositions and, in particular, to cobalt-based alloys having high hardness and desirable wear and corrosion resistance for cladding applications.

BACKGROUND

Commercial wear resistant Stellite alloys are derived from the Co—Cr—W—C family first investigated by Elwood Haynes in early 1900s. Hardfacing alloys of the Co—Cr—W—C type exist in several modifications, and it is generally known that the available range of commercial grades satisfies most industry requirements. However, the high carbon Co—Cr—W—C alloys may occasionally be inadequate especially where components of pumps, impellers, etc., must often withstand the simultaneous abrasive and corrosive action of media composed of a suspension of hard mineral particles in aqueous solution. Such failures are encountered, for instance, in the superphosphate industry.

The Co—Cr—Mo—C type Stellite 700 series alloys developed at Kennametal Stellite, Inc. raise the standards for wear and corrosion resistant alloys. These Stellite alloys have the unusual combination of excellent wear resistance and exceptional corrosion resistance in environments that are either reducing or complex. Co-based Stellite alloys such as Stellite 720 with nominal composition of Co-33Cr-18Mo-2.45C are known for their excellent wear and corrosion resistance. Accordingly, Stellite 720 alloy can be used as a coating applied in the green state by slurry or cloth processes, such as the UltraFlex and Conforma Clad technologies offered by Kennametal, Inc. The green coating is subsequently sintered to fuse the coating into a dense, uniform layer metallurgically bonded to the substrate. However, Stellite 720 is difficult to apply by thermal spraying techniques, such as high velocity oxygen fuel (HVOF). Further complicating coating adherence is the general concept that thickness limitations exists for spraying various coating compositions on a given substrate. Therefore, the wear resistant and corrosion resistant properties of Co—Cr—Mo—C type alloys remain largely unrealized for thermal spray applications.

SUMMARY

In view of the foregoing disadvantages, cobalt-based alloy compositions are described herein having properties compatible with thermal spray and sintering techniques. Such alloy compositions can provide claddings on a variety of metallic substrates having complex geometries, wherein the claddings exhibit desirable density, hardness, wear resistance and corrosion resistance. Briefly, an alloy composition described herein comprises 15-25 wt. % chromium, 15-20 wt. % molybdenum, 0-15 wt. % tungsten, 10-20 wt. % nickel, 2.5-3.5 wt. % boron, 2.5-4.5 wt. % silicon, 1-2 wt. % carbon and the balance cobalt, wherein a ratio of boron to silicon (B/Si) in the alloy composition ranges from 0.5 to 1.0.

In another aspect, coated articles are described. A coated article, in some embodiments, comprises a metallic substrate and a sintered alloy coating adhered to the metallic substrate, the sintered alloy coating comprising 15-25 wt. % chromium, 15-20 wt. % molybdenum, 0-15 wt. % tungsten, 10-20 wt. % nickel, 2.5-3.5 wt. % boron, 2.5-4.5 wt. % silicon, 1-2 wt. % carbon and the balance cobalt. A ratio of boron to silicon (B/Si) in the sintered alloy composition can range from 0.5 to 1.0. The sintered alloy coating, in some embodiments, can exhibit porosity less than 2 vol. % and hardness of at least 60 HRC. Further, the sintered alloy coating can have thickness of at least 0.020 inches.

Methods of applying coatings to a substrate are also described herein. In some embodiments, a coating application method comprises providing a powder alloy composition including 15-25 wt. % chromium, 15-20 wt. % molybdenum, 0-15 wt. % tungsten, 10-20 wt. % nickel, 2.5-3.5 wt. % boron, 2.5-4.5 wt. % silicon, 1-2 wt. % carbon and the balance cobalt and applying the powder alloy composition to the substrate by a thermal spray process. The applied alloy composition is then sintered to provide a sintered alloy coating metallurgically bonded to the substrate. The thermal spray process, in some embodiments, is HVOF or high velocity air fuel (HVAF).

These and other embodiments are further described in the detailed description which follows.

DETAILED DESCRIPTION

Figure 1:
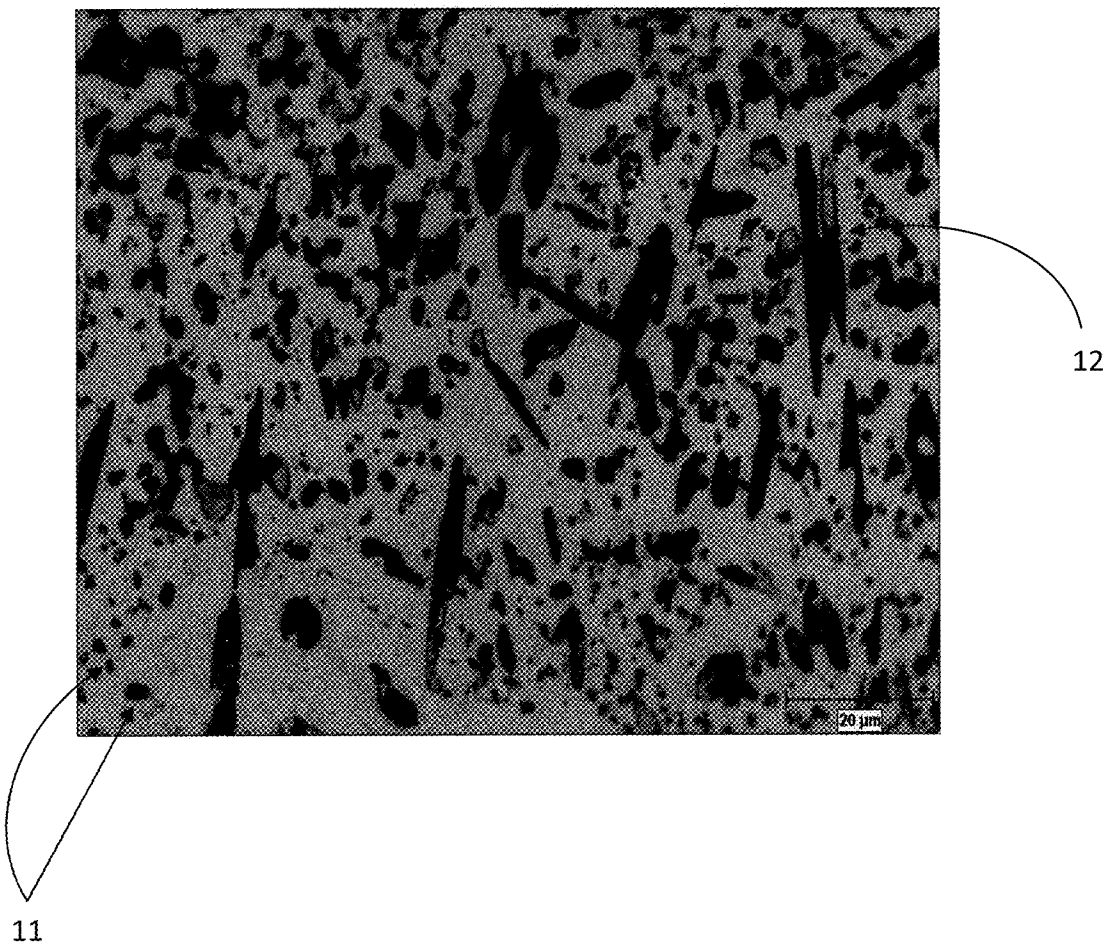
FIG. 1 is a metallographic image illustrating microstructural aspects of a sintered Co-based alloy coating applied according to methods described herein.

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention. Numerous modifications and adaptations will be readily apparent to those of skill in the art without departing from the spirit and scope of the invention.

I. Alloy Compositions

In one aspect, alloy compositions are described herein having properties compatible with thermal spray and sinter fuse techniques for providing claddings exhibiting desirable density, hardness, wear resistance and corrosion resistance. Generally, an alloy composition described herein comprises 15-25 wt % chromium, 15-20 wt. % molybdenum, 0-15 wt. % tungsten, 10-20 wt. % nickel, 2.5-3.5 wt. % boron, 2.5-4.5 wt. % silicon, 1-2 wt. % carbon and the balance cobalt, wherein a ratio of boron to silicon (B/Si) in the alloy composition ranges from 0.5 to 1.0. In some embodiments, an alloy composition comprises 18-20 wt. % chromium, 17-18 wt. % molybdenum, 0-5 wt. % tungsten, 11-15 wt. % nickel, 2.7-3.3 wt. % boron, 3.7-4.3 wt. % silicon, 1.3-1.8 wt. % carbon and the balance cobalt. In such embodiments, the B/Si ratio can range from 0.65 to 0.85.

An alloy composition described herein can also have a ratio of nickel to a sum of boron and silicon in the alloy, [Ni/(B+Si)], ranging from 2.0 to 3.0. In some embodiments, the Ni/(B+Si) ratio ranges from 2.1 to 2.5. Boron, silicon and nickel content of the alloy composition can be carefully controlled to provide properties facilitating coating deposition by thermal spray and sinter fusion techniques. Increasing amounts of boron and silicon, for example, can reduce the melting point of the alloy composition and increase the melting range. Lower melting point and increased melting range can enhance fusibility of the alloy composition. In some embodiments, an alloy composition described herein has a liquidus temperature less than 1150° C. For example, an alloy composition can have a liquidus ranging from 1090° C. to 1130° C. Moreover, an alloy composition can have a melting range (liquidus-solidus) of at least 50° C. In some embodiments, an alloy composition described herein has a melting range of 50° C. to 70° C. Importantly, boron, silicon and nickel contents of the alloy composition require careful balance to achieve the foregoing thermal properties. Boron, silicon and nickel, for example, each have differing effects on melting point depression of the alloy composition. In view of these effects, the B/Si ratio and Ni/(B+Si) ratio have been defined above. In further embodiments, the sum of boron and silicon (B+Si) in the alloy composition can generally range from 6.0 to 8.0. B+Si can also range from 6.5 to 7.5 to achieve desired theitiial properties of the alloy composition for enhancing deposition by thermal spray and sinter fuse techniques.

Cobalt-based alloy compositions described herein can be provided in any desired form. For example, in some embodiments, the alloy composition is in powder form suitable for one or more powder metallurgical applications. As discussed below, the alloy composition can be in powder form suitable for thermal spray, such as HVOF of HVAF, followed by sinter fusion. Moreover, the powder alloy composition can be suitable for slurry application to a substrate followed by sintering, such as in the UltraFlex technology offered by Kennametal, Inc. In additional embodiments, the powder alloy composition can be suitable for cloth application to a substrate followed by sintering, such as in the Conforma Clad technology offered by Kennametal, Inc. In some embodiments, a powder alloy of composition described herein has an average particle size of 0.1 μm to 200 μm. In other embodiments, the powder alloy has an average particle size selected from Table I.

TABLE I

| Co-based Alloy Average Particle Size (μm) |
|---|
| 75-125 |
| 20-100 |
| 5-50 |
| 10-25 |
| 0.1-10 |

Alternatively, an alloy composition can be provided as a sheet or other non-particulate morphology.

II. Coated Articles

In another aspect, coated articles are described. An coated article, in some embodiments, comprises a metallic substrate and a sintered alloy coating adhered to the metallic substrate, the sintered alloy coating comprising 15-25 wt. % chromium, 15-20 wt. % molybdenum, 0-15 wt. % tungsten, 10-20 wt. % nickel, 2.5-3.5 wt. % boron, 2.5-4.5 wt. % silicon, 1-2 wt. % carbon and the balance cobalt. In other embodiments, the sintered alloy coating can have any composition described in Section I above. Accordingly, the sintered alloy composition can have any B/Si ratio, Ni/(B+Si) ratio and/or B+Si value detailed in Section I.

The sintered alloy coating also exhibits desirable properties including, but not limited to, density, hardness, wear resistance and thickness. In some embodiments, the sintered alloy coating is fully dense or substantially fully dense. The sintered alloy coating, for example, can generally have porosity less than 3 vol. % or less than 2 vol. %. Moreover, the sintered alloy coating can be free of cracks. Sintered alloy coatings applied by thermal spray and/or sintering techniques can often develop cracks during cooling. However, sintered alloy coatings of composition described herein resist cracking and can exhibit a continuous, crack-free structure over the substrate surface. The crack-free morphology, in some embodiments, can persist subsequent to thermal cycling or further thermal treatment of the coated article, such as heat treatments employed to restore the mechanical properties of the underlying substrate after coating.

The sintered alloy coating can exhibit hardness of at least 55 HRC. Hardness values recited herein are determined according to ASTM E-18-02 Standard Test Method for Rockwell Hardness of Metallic Materials. In some embodiments, the sintered alloy coating has hardness selected from Table II.

TABLE II

| Sintered Alloy Coating Hardness (HRC) |
|---|
| 57-65 |
| 60-70 |
| 60-65 |
| 61-64 |

The sintered alloy coating may also exhibit advantageous abrasion wear resistance. In some embodiments, the sintered alloy coating has an adjusted volume loss (AVL) of less than 20 $mm^3$ according to ASTM G65 Standard Test Method for Measuring Abrasion Using the Dry Sand/Rubber Wheel, Procedure A. A sintered alloy coating described herein may also exhibit an AVL selected from Table III.

TABLE III

| Sintered Alloy Coating AVL ($mm^3$) ASTM G65, Proc. A |
|---|
| <15 |
| 10-20 |
| 10-15 |
| 12-14 |

The foregoing physical properties of hardness and abrasion resistance may partially be attributed to microstructure of the sintered alloy coating. Laves phases of CoMoSi and/or $Co_3$ $Mo_2Si$, for example, can provide enhanced abrasion wear resistance as well as corrosion resistance to reducing environments, such as exposure to hydrochloric acid (HCl) or sulfuric acid ($H_2SO_4$) at elevated temperatures. Microstructural amorphous regions may contribute to sintered alloy hardness and strength in addition to intermetallic borides and/or metal carbides. In some embodiments, metal carbide phases of the formulas $M_7(C,B)_3$ and/or $M_{23}(C,B)_6$ are present, wherein M is the metal component including, but not limited to, chromium. Laves phases of the sintered alloy, in some embodiments, are non-dendritic, nodular or irregular shaped. Additionally, metal carbides and/or metal borides of the sintered alloy can be dendritic. FIG. 1 illustrates CoMoSi and/or $Co_3$ $Mo_2Si$ Laves phases 11 and dendritic intermetallic borides 12 of sintered Co-based alloy coatings described herein.

As described above, individual constituents of the sintered alloy composition require careful balance to achieve the advantageous properties of high hardness and wear resistance while maintaining desirable corrosion resistance and resistance to cracking. Molybdenum and silicon content of the alloy are maintained in sufficient amounts to induce the formation of Laves phases for wear and corrosion resistance. However, these Laves phases are not so abundant such that the ductility and impact strength of the sintered alloy are compromised leading to cracking and other failure mechanisms. Similarly, carbon and boron are present in required amounts for beneficial metal carbide and metal boride formation without complexing or depleting large quantities of molybdenum as $Mo_6C$. Competition for molybdenum can adversely affect both Laves phase and carbide phase formation. This balance between individual alloy constituents yields sintered alloy coatings having the desirable physical and chemical properties described herein.

The sintered alloy coating can be metallurgically bonded to the metallic substrate. In some embodiments, a transition region can exist at the interface of the sintered alloy coating and the metallic substrate. The interfacial transition region can generally have thickness less than 100 μm, such as 10-75 μm. Sintered alloy coatings described herein can have any desired thickness. For example, a sintered alloy coating can have thickness of 0.02 inch to 0.06 inch. In other embodiments, thickness of the sintered alloy coating is selected from Table IV.

TABLE IV

| Sintered Alloy Coating Thickness (inch) |
|---|
| >0.030 |
| 0.030-0.055 |
| 0.035-0.050 |
| >0.060 |
| 0.005-0.080 |
| 0.01-0.03 |

Substrates to which coatings described herein are adhered can include any metal or alloy not inconsistent with the objectives of the present invention. In some embodiments, the substrate comprises nickel-based alloy. Suitable nickel-based alloy substrates can include those commercially available under the INCONEL®, HASTELLOY® and/or BALCO® trade designations. In other embodiments, the substrate comprises iron-based alloy including, but not limited to, various steels such as carbon steels, alloy steels, tool steels or stainless steels. In several specific embodiments, the substrate can be selected from the group consisting of IN718, IN625, 300 series stainless steels and 400 series stainless steels. Additionally, the metallic substrate can have any function or application. For example, the substrate can be a component of a fluid control system. In some embodiments, substrates include gate valves, valve ball and seat rings, pump plungers, pump casings, pump impellers, pump sleeves, high pressure compressor shafts and marine components. Further, coated articles described herein can be used in oil well and/or gas drilling, petrochemical and power generation applications, industrial food production as well as general engineering applications involving wear, abrasion corrosion and/or high temperature.

III. Methods of Applying Alloy Coatings

In another aspect, methods of applying coatings to a substrate are also described herein. In some embodiments, a coating application method comprises providing a powder alloy composition including 15-25 wt. % chromium, 15-20 wt. % molybdenum, 0-15 wt. % tungsten, 10-20 wt. % nickel, 2.5-3.5 wt. % boron, 2.5-4.5 wt. % silicon, 1-2 wt. % carbon and the balance cobalt and applying the powder alloy composition to the substrate by a thermal spray process. The applied alloy composition is sintered to provide a sintered alloy coating metallurgically bonded to the substrate. In other embodiments, the powdered alloy can have any composition described in Section I above. Accordingly, the powdered alloy can have any B/Si ratio, Ni/(B+Si) ratio and/or B+Si value detailed in Section I.

Further, the powder alloy composition can have any average particle size suitable for thermal spray and sintering techniques, including the average particle sizes listed in Table I herein.

Thermal spray techniques for application of the powder alloy to the substrate generally employ high velocity gas or liquid fuel processes to achieve a dense coating. For example, HVOF and HVAF processes can be used for application of the alloy powder to the substrate. Surface speeds and powder feed rates are controlled to provide coatings of substantially uniform thickness. In some embodiments, powder alloy feed rates range from 20-120 g/min and surface speeds generally range from 200-400 ft./min. In other embodiments, conventional, lower velocity thermal spray techniques can be used for application of powder alloy to the substrate. Techniques employing oxy-acetylene systems, for example, can be used for powder alloy application. The substrate surface can also be prepared prior to coating application by thermal spray. The substrate surface, for example, can be cleaned with suitable solvent and/or grit blasted. Grit blasting the substrate can induce a roughened surface condition for enhancing mechanical bonding of the coating applied by thermal spray. In some embodiments, surfaces of the substrate in areas receiving coating application have roughness of 250 Ra or greater. Areas of the substrate not receiving the alloy coating can be masked or otherwise shielded from grit blasting processes.

The alloy coating can be applied by a thermal spray process to any thickness not inconsistent with the objectives of the present invention. In some embodiments, the alloy coating is applied to a thickness of 0.005 inch to 0.080 inch. Additional thicknesses of the applied coating are provided in Table III herein. Once applied, the coating and substrate are cooled in a manner to avoid generating stresses that could lead coating cracking and/or delamination. In some embodiments, the alloy coating and substrate are slow cooled in air.

The coated article is subsequently subjected to heat treatment to sinter the applied alloy composition resulting in a sintered alloy coating metallurgically bonded to the substrate. In some embodiments, the coated article is heated in vacuum or under inert atmosphere to a temperature and for a time period sufficient to provide a sintered alloy coating metallurgically bonded to the substrate. Sintering temperatures and time can be adjusted according to the specific compositional identity of the applied cobalt-based alloy and/or compositional identity of the metallic substrate. Generally, sintering temperatures can range from 1030° C. to 1150° C., and sintering times can range from several minutes to several hours. Alternatively, heat can be applied directly the cobalt-based alloy for sintering. In such embodiments, a torch or other apparatus for the local application of heat can be employed for sintering operations. The resulting sintered alloy coating can have any of the properties described in Section II herein. For example, the sintered alloy coating can exhibit density, hardness, wear resistance, corrosion resistance and microstructural properties detailed in Section II.

These and other embodiments are further illustrated by the following non-limiting examples.

Example 1—Coated Articles

Powder alloy having composition of 18-20 wt. % chromium, 17-18 wt. % molybdenum, 11-15 wt. % nickel, 2.7-3.3 wt. % boron, 3.7-4.3 wt. % silicon, 1.3-1.8 wt. % carbon and the balance cobalt was applied to Inconel 718 coupons by HVOF. Three Inconel substrates were coated at thicknesses of about 0.026 inch, 0.039 inch and 0.049 inch. HVOF conditions were maintained within the parameters set forth in Table V.

TABLE V

| HVOF Parameters | | | |
|---|---|---|---|
| Speed (ft./min) | Powder Feed Rate (g/min) | Thickness/pass (inch) | Substrate Temperature (C.) |
| 200-400 | 20-120 | ≤0.002 | <200 |

Figure 2B:
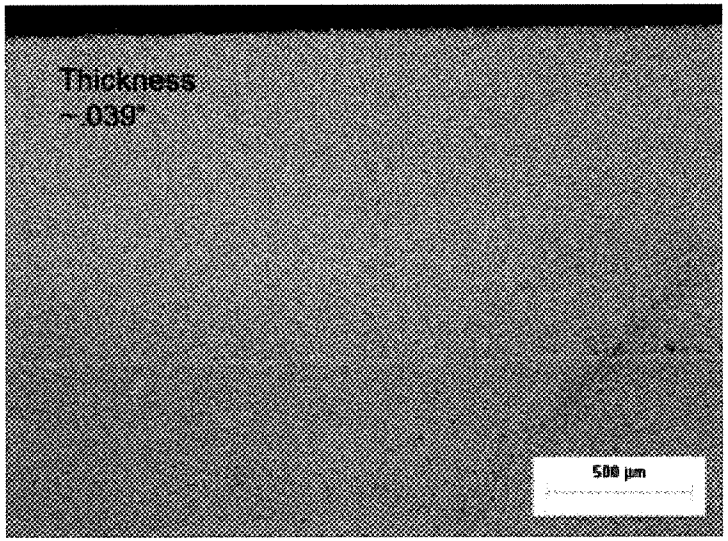
FIGS. 2(*a*)-(*c*) are cross-sectional photomicrographs of nickel-based alloy substrates having sintered Co-based alloy coatings metallurgically bonded thereto according to some embodiments described herein.
Figure 2A:
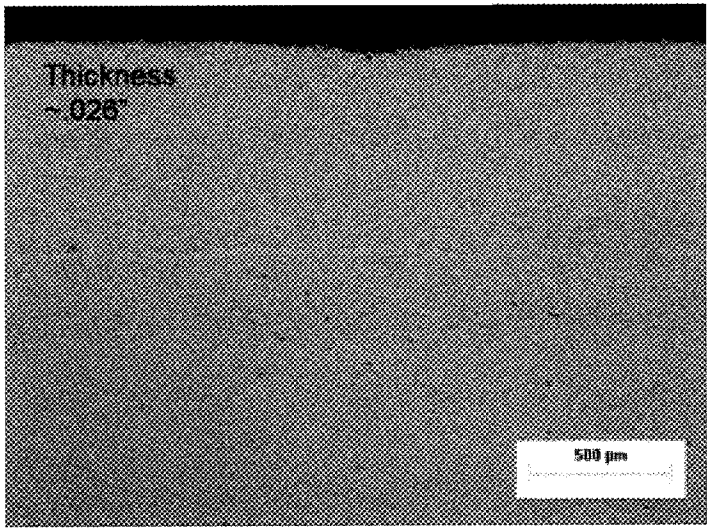
Figure 2C:
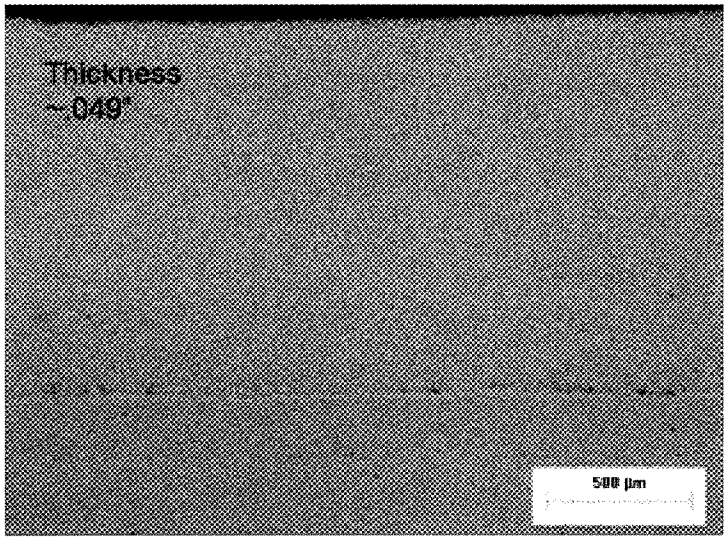

Subsequent to HVOF, the coated substrates were placed in a furnace and the Co-based alloy coatings were vacuum sintered at 1070° C. for a time period of 30 minutes to 2 hours, followed by furnace cooling to the aging temperature and cooling to under 260° C. FIGS. 2(*a*)-(*c*) are cross-sectional photomicrographs of the sintered alloy coatings and Inconel substrates. As illustrated in FIGS. 2(*a*)-(*c*), the sintered Co-based alloy coatings are metallurgically bonded to the substrates and exhibit uniform microstructure. Moreover, the sintered Co-based alloy coatings are free of cracks and have no visible porosity. Sintered Co-based alloy coating hardness was measured according to ASTM E-18-02 Standard Test Method for Rockwell Hardness of Metallic Materials and determined to be 63 HRC and 63 HRC and 62 HRC. These hardness values exceeded those of HVOF-sinter fuse coatings provided by Colmonoy 88 and Deloro 75 as set forth in Table VI.

TABLE VI

| Coating Hardness (HRC) | | |
|---|---|---|
| Alloy | Composition | Average Hardness |
| Colmonoy 88 | Ni—15Cr—15.5W—0.6C—3B—4Si | 59 |
| Deloro 75 | Ni—16Cr—2.5Mo—0.7C—3.5B—4.5Si | 54 |

Moreover, the sintered Co-based alloy coatings exhibited erosion rates of 0.041-0.043 $mm^3/g$ at a particle impingement angle of 90° according to ASTM G76-07—Standard Test Method for Conducting Erosion Tests by Solid Particle Impingement Using Gas Jets. For comparative purposes, this erosion wear resistance was similar to Conforma Clad WC219 commercially available from Kennametal, Inc. WC219 is metal matrix composite cladding having tungsten carbide (WC) particle loading of 48 wt. % in Ni—Cr matrix alloy.

Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. An article comprising:

a metallic substrate; and an alloy coating adhered to the metallic substrate via high velocity oxygen fuel (HVOF) spraying or high velocity air fuel (HVAF) spraying followed by sintering, the alloy coating comprising 15-25 wt. % chromium, 15-20 wt. % molybdenum, 0-15 wt. % tungsten, 10-20 wt. % nickel, 2.5-3.5 wt. % boron, 2.5-4.5 wt. % silicon, 1-2 wt. % carbon and the balance cobalt, wherein microstructure of the alloy comprises Co—Mo—Si Laves phases and intermetallic phases including metal borides and metal carbides.

2. The article of claim 1, wherein the alloy coating has less than 2 vol. % porosity.

3. The article of claim 1, wherein the sintered alloy coating has hardness of greater than 55 HRC.

4. The article of claim 1, wherein the alloy coating has hardness of 57-64 HRC.

5. The article of claim 1, wherein the alloy coating has hardness of 60-70 HRC.

6. The article of claim 1, wherein the alloy coating has an adjusted volume loss (AVL) of less than 20 $mm^3$ according to ASTM G65, Procedure A.

7. The article of claim 1, wherein the alloy coating has an AVL of 10-15 $mm^3$ according to ASTM G65, Procedure A.

8. The article of claim 1, wherein microstructure of the alloy coating has one or more amorphous regions.

9. The article of claim 1, wherein the metal boride intermetallic phases are dendritic.

10. The article of claim 1, wherein the alloy coating is metallurgically bonded to the metallic substrate.

11. The article of claim 1, wherein the alloy coating has thickness of 0.005 inch to 0.08 inch.

12. The article of claim 1, wherein the metallic substrate is formed of nickel-based alloy or iron-based alloy.

13. The article of claim 1, wherein the substrate is a component of a fluid flow control system.

14. The article of claim 1, wherein the Co—Mo—Si Laves phases are non-dendritic.

15. The article of claim 1, wherein the Co—Mo—Si Laves phases are nodular.

16. The article of claim 1, wherein a ratio of boron to silicon (B/Si) in the sintered alloy coating ranges from 0.5 to 1.0.

17. The article of claim 1, wherein the B/Si ratio ranges from 0.65 to 0.85.

18. The article of claim 1, wherein a ratio of nickel to a sum of boron and silicon in the sintered alloy coating [Ni/(B+Si)] is in the range of 2.0-3.0.

19. The article of claim 18, wherein the Ni/(B+Si) ratio ranges from 2.1 to 2.5.

20. The article of claim 1, wherein the alloy coating has a liquidus temperature of 1090° C. to 1130° C.

21. The article of claim 1, wherein the alloy coating has a melting range of 50° C. to 70° C.

22. The article of claim 1, wherein a sum of boron and silicon in the sintered alloy coating is from 6.0 to 8.0.

* * * * *